US005135041A

United States Patent [19]

Goss

[11] Patent Number: 5,135,041

[45] Date of Patent: Aug. 4, 1992

[54] MULTI-MOLD CENTRIFUGAL CASTING APPARATUS

[75] Inventor: Douglas J. Goss, North Kingstown, R.I.

[73] Assignee: Conley Casting Supply Corp., Warwick, R.I.

[21] Appl. No.: 786,055

[22] Filed: Oct. 31, 1991

[51] Int. Cl.[5] ..... B22D 13/06

[52] U.S. Cl. ..... 164/290; 164/292; 425/DIG. 44

[58] Field of Search ..... 164/6, 286, 287, 289, 164/290, 292, 339; 425/425, DIG. 44; 264/311

[56] References Cited

U.S. PATENT DOCUMENTS 2,811,757 11/1957 Banister ..... 164/292

4,723,904 2/1988 Maynard et al. ..... 425/425

*Primary Examiner*—Kuang Y. Lin

*Attorney, Agent, or Firm*—Salter, Michaelson & Benson

[57] ABSTRACT

Multi-mold centrifugal casting system comprising basically conventional centrifugal casting apparatus except that instead of receiving a single mold, i.e., one pair of mold halves, a plurality of molds are mounted in the apparatus in stacked relation, with all mold halves having central openings to define a plurality of ring-like molds. A manifold member is positioned in the center of the stacked ring-like molds for receiving and simultaneously feeding molten metal to each of the stacked molds.

9 Claims, 2 Drawing Sheets

MULTI-MOLD CENTRIFUGAL CASTING APPARATUS

BACKGROUND OF THE INVENTION

The present invention relates generally to centrifugal casting apparatus, and is particularly concerned with the type of apparatus wherein molds of rubber or the like are positioned in centrifugal casting machines so as to cast small metallic parts, such as jewelry and the like.

Centrifugal casting utilizing rubber molds is extremely old and well known, particularly in the jewelry field. The molds, which are constructed of a rubber-like material, such as natural rubber, silicone, SBR, or the like, traditionally comprise two circular mold halves having mold cavities and radially extending gates formed on their abutting surfaces so that when the mold halves are clamped together in the casting machine, said abutting surfaces cooperate with each other to define the desired mold cavities with gates extending radially inwardly from said cavities. In the traditional mold arrangement, the upper mold half has a circular opening at its central portion, while the lower mold half comprises a complete disc, i.e., it has no such central opening. The mold halves are positioned in the casting machine with the working surfaces 1 thereof in abutting relationship with the mold halves positioned between a movable piston plate and a pressure plate, whereby movement of the piston plate by pneumatic power means or the like clamps the two mold halves against said pressure plate whereupon said mold halves are tightly clamped against each other. Locating means are provided on the inner working surfaces of the mold halves to insure proper orientation of one half with respect to the other. At this point, and with the machine spinning or rotating by conventional drive means, molten metal is poured, usually manually, into the space defined by the central opening of the upper mold half, whereupon centrifugal force causes the molten metal to flow radially outwardly through the radially extending gates to the mold cavities until said cavities are completely filled with the molten metal. At this point the metal is allowed to solidify, the molds are separated, and the castings are removed therefrom, after which the gate castings are broken away from the cast articles, and the latter are then finished by conventional techniques to remove surface irregularities and the like. This process has long been used in the jewelry industry to produce relatively inexpensive jewelry castings of so-called white metal, although other alloys can be used.

Although generally satisfactory, the above described centrifugal casting process has a number of disadvantages. First of all, to insure proper casting, substantial clamping pressure must be applied to the mold halves, which pressure, because of the rubber-like material of which the molds are made, results in some degree of distortion of the mold cavities. This distortion is somewhat amplified by the relatively high rotational speed that is required to insure sufficient centrifugal force to fill the mold cavities. Obviously this distortion of the mold cavities results in comparable distortion of the cast parts which, of course, is highly undesirable, and while such distortion may be something that one can live with when dealing with relatively inexpensive cast jewelry, it effectively prevents mechanical parts having any kind of precision requirements, such as nuts and bolts, for example, from being satisfactorily made by the centrifugal casting process.

In addition, a common problem with rubber molds of this type is so-called "flashing",i.e., erosion of the surfaces of the molds adjacent the mold cavities which permits small amounts of molten metal to be forced outwardly from the mold cavities between the mold halves. It is conventional to minimize this "flashing" phenomenon by placing shims at the outer surfaces of the mold halves to increase the clamping pressure at those areas of the mold where "flashing" is taking place.

Another problem is that the mold cavities must be back-vented, i.e., vents must be provided to receive the air that is forced out of the mold cavities when the molten metal flows therein.

Aside from distortion, "flashing", and back-venting, conventional rubber molds for centrifugal casting require a substantial degree of skill from the person operating the casting machine. More specifically, proper clamping pressure must be applied to the mold halves, appropriate shims must be inserted, and the rotational speed of the casting machine is quite critical, as is the amount of molten metal that is manually poured into the mold. Thus, the effectiveness of the conventional centrifugal casting process is to a large extent dependent on the skill of the particular operator involved.

Finally, since it has heretofore been conventional to place only one mold in the casting machine for each molding operation, the time required to produce the desired number of cast parts is necessarily magnified.

SUMMARY OF THE INVENTION

The basic and salient concept of the present invention is the provision of modified rubber molds whereby a plurality of such molds may be positioned in the casting machine in stacked relation, with means for receiving and simultaneously feeding the molten metal to each mold. Thus, if three molds are positioned in the casting machine, the production output will be three times as great. Therefore, a primary object and advantage of the present invention is to increase the production capacity of the casting apparatus, with only minor changes having to be made to conventional apparatus, although, as aforesaid, the rubber molds are somewhat different than the presently existing rubber molds. Specifically, in the present invention, both the upper and lower mold halves are provided with openings at their central portion wherein the entire mold comprises a ring-like configuration. This permits a plurality of these ring-like molds to be stacked upon each other, and a manifold member is positioned in the center space of the stacked molds for receiving and feeding the molten metal simultaneously to each mold.

In addition to the obvious increase in production capacity that results from the present invention, it has also been found that the stacked ring-like molds of the present invention require less clamping pressure and less rotational speed during the casting operation, thus greatly minimizing the distortion and "flashing" that takes place. Also, the reduction in clamping pressure greatly reduces back-venting requirements, thus making the molds easier to make. Further, the criticality of clamping pressure, rotational speed, and amount of molten metal poured into the molds no longer exists, thus, permitting even an unskilled operator to effectively operate the casting apparatus of the present invention.

Thus, the primary object of the present invention is to provide a novel centrifugal casting system embodying novel rubber molds that result in greatly increased production capacity, as well as greatly improved cast parts.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE PREFERRED FORM OF THE INVENTION

Figure 1:
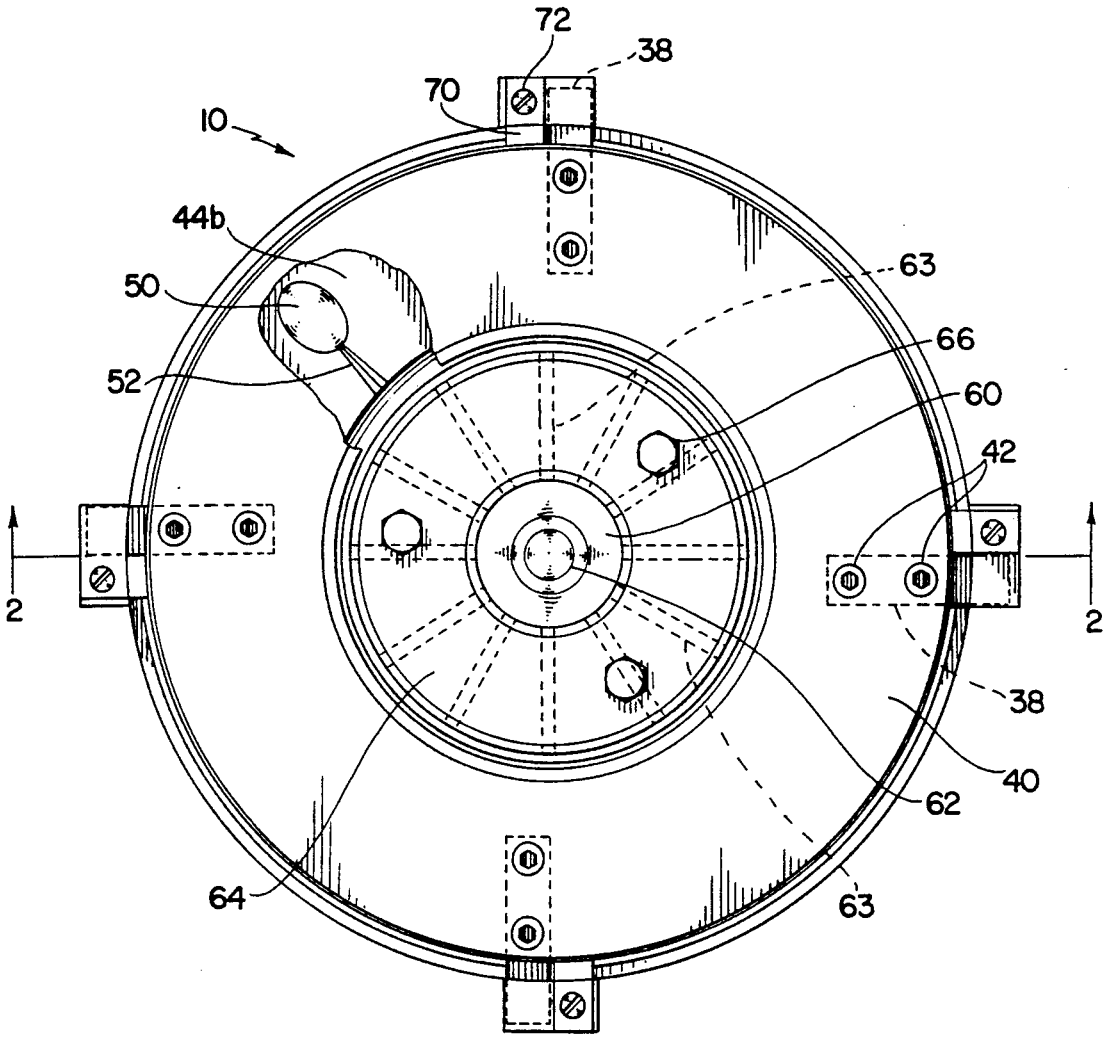
FIG. 1 is a top plan view of centrifugal casting apparatus embodying the present invention with a portion broken away for purposes of illustration.
Figure 2:
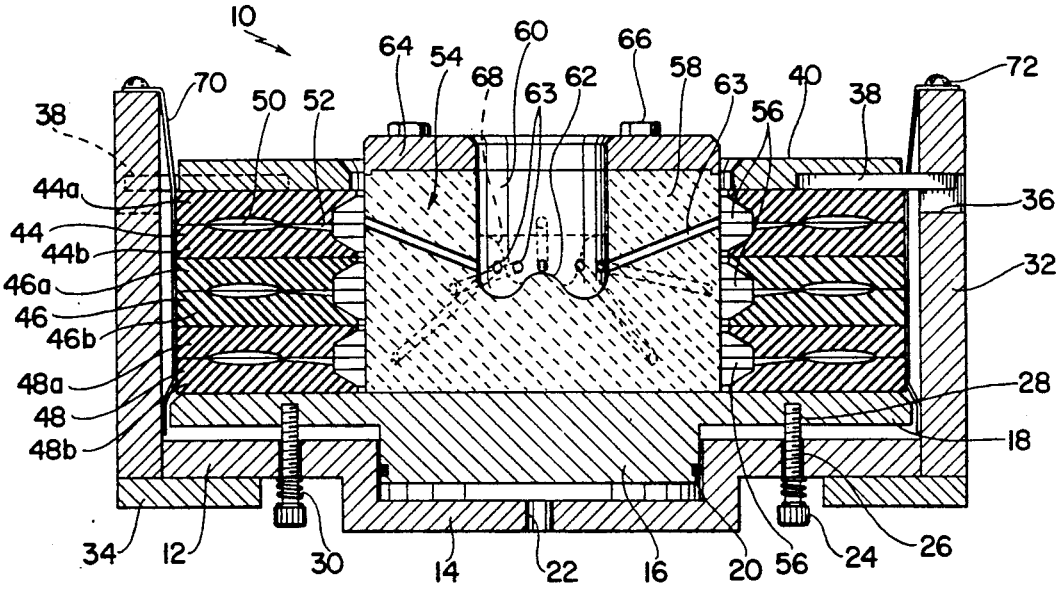
FIG. 2 is a section taken on line 2—2 of FIG. 1.

Referring to the drawings, and more particularly FIG. 2, centrifugal casting apparatus is shown generally at 10 comprising a circular fixed based plate 12 having a stepped depending central portion 14 which receives depending central portion 16 of piston plate 18 in sliding relation with an 0-ring 20 providing a sliding seal between the portions 14 and 16. A port 22 is provided in portion 14 through which pressurized air may be introduced by means of any suitable pneumatic apparatus so as to force piston plate 18 in an upward direction for reasons which will hereinafter become apparent. Studs 24 having threaded shanks 26 extend freely and slidably through base 12 and are threadedly received in plate 18 as at 28. Springs 30 positioned between the lower surface of plate 12 and the heads of studs 24 normally bias piston plate 18 to its downward or inoperative position, it being understood that when pressurized air is introduced through port 22, piston 18 is forced to move upwardly against the bias of the springs 30.

A plurality of upright stanchions 32, preferably four in number spaced approximately 90° from each other, extend upwardly from the outer periphery of base plate 12, said stanchions being secured to base plate 12 by flanges 34 that extend beneath base plate 12, said flanges being secured to stanchions 32 and to base plate 12 by any suitable means, such as screws or the like (not shown). Each stanchion has a notch 36 adjacent to but spaced from its upper extremity, said notches receiving therein the outer ends of lugs 38 secured to a circular ring-like pressure plate 40 by any suitable means, such as screws 42. Positioned between pressure plate 40 and pressure piston 18 are a plurality of molds 44, 46 and 48. Said molds are constructed of any suitable rubber-like or elastomeric material, such as silicone, SBR, natural rubber, or the like, the sole requirement of said material being that it be sufficiently flexible and that it be able to withstand the heat of the molten metal to which it is exposed. It will therefore be understood that when reference is hereinafter made to "rubber molds", the term is being used broadly to cover all equivalent elastomeric materials. Each of the molds 44, 46 and 48 comprises upper mold halves 44*a*, 46*a*, and 48*a*, as well as lower mold halves 44*b*, 46*b*, and 48*b*. The inner abutting surfaces of each of said mold halves are provided with mold cavities 50 from which gates or passages 52 extend radially inwardly. It is important to note that all of said mold halves are ring-like members having open central portions, of the same diameter whereby when said molds are stacked one upon the other, a central space is provided for receiving a manifold member shown generally at 54. Specifically, the stacked molds, as well as manifold member 54, are positioned on the top surface of piston plate 18, and then after the plurality of molds have been so positioned, annular pressure plate 40 is positioned on top of the uppermost mold half 44*a* and is then slightly rotated so that lugs 38 engage within notches 36 on the stanchions 32. This interengagement or locking action limits upward movement of plate 40, whereupon introduction of pneumatic pressure through port 22 causes piston plate 18 to move upwardly to the position illustrated in FIG. 2, in which position the molds 44, 46 and 48 are clamped between plates 18 and 40 with the desired amount of pressure, which pressure is approximately 25% of the clamping pressure required to properly clamp the upper and lower halves of conventional rubber molds now in existence. In addition, the apparatus 10, which is rotated by any conventional means (not shown) need only be rotated at approximately one-half the speed that is required for conventional single-mold casting machines now in existence. This reduction in clamping pressure and rotational speed minimizes distortion of the mold cavities, minimizes "flashing",and reduces or entirely eliminates the need for back-venting.

It is important to note that the inner edges of molds 44, 46 and 48 are provided with an annular recess 56, a portion of which is formed in the upper mold half and the remaining portion in the lower mold half, whereupon when the two mold halves are in aligned abutting relation, the annular recess 56 automatically results. Also, as will be evident from FIG. 2, all of the molds are of the same size and configuration, whereby the molds can be stacked in any order.

Manifold member 54 comprises a cylindrical housing 58 preferably constructed of a ceramic material, said housing having a center well 60, the bottom surface of which is of undulating configuration as a result of having a central hump 62 thereon. A plurality of elongated bores or passageways 63 extend from the inner wall of well 60 at a height just above the top of hump 62 through the body of said housing into communication with the aforesaid annular recesses 56 at spaced points around the circumferential extent of said recesses. A hold-down disc 64 is positioned on the top of housing 58, and fastening elements such as threaded bolts 66 extend through disc 64, housing 58, into threaded securement with piston plate 18 to securely clamp manifold member 54 onto said piston plate.

In operation and use, and with the ring molds 44, 46 and 48 clamped between piston plate 18 and pressure plate 40 with the proper amount of pressure, molten metal is poured into well 60 while the apparatus 10 is rotating, as a result of which, and as a result of the undulated configuration 62 of the bottom wall of the well, centrifugal force causes the molten metal to assume a wave-like configuration as shown in broken lines at 68 in FIG. 2, wherein the molten metal has in effect climbed up the side wall of well 60 to a point well above the passages 63. Thus, centrifugal force carries the molten metal through the passages 63 to each of the annular recesses 56 whereupon the latter become filled with the molten metal so as to provide a reservoir for feeding the molten metal to gates 52 and cavities 50, which feeding action also takes place because of the centrifugal force that results from the spinning or rotation of apparatus 10. The important thing here is that the volume of the annular recesses 56 in each mold is greater than the combined volumes of the cavities 50 and gates 52 in each mold, whereby said recesses 56 insure an ample supply of molten metal for completely filling each mold cavity. Since it is important that the annular recesses 56 be uniform in size throughout their circumferential extent, in order to insure uniform filling of all the mold cavities, it is important that the molds be properly centered with respect to the rotational axis of the apparatus 10. This is achieved by providing spring arms 70 on each of the stanchions 32, said spring arms being secured to the top of each stanchion by screws 72, said spring arms further imparting uniform resilient pressure to the outer edges of said molds at four equally-spaced points around the outer circumferences of said molds so as to retain the molds properly centered. In addition, where such becomes necessary to insure equal flow of molten metal to all of the annular recesses 56, the diameters of the passages 63 can be varied. Also, as clearly shown in FIG. 2, the innermost circular edges of molds 44, 46 and 48 are spaced from the outer surface of cylindrical housing 58. This spacing prevents any back pressure from building up in the recesses 56 that would tend to impede outward flow of metal through manifold passages 63, and also permits upward removal of the molds from apparatus 10 without any frictional binding between the mold inner edges and cylindrical housing 58.

Where white metal is employed as the casting alloy, which is quite conventional in the jewelry industry, a skin comprised of tin oxide automatically forms on the surface of the molten metal, said formation being known in 0 the industry as "dross", which signifies an accumulation of oxides. During the casting operation, dross causes discoloration and porosity in the cast parts and hence is highly undesirable. In the instant invention, however, it has been found that when the molten metal is introduced into the central well of the manifold member, centrifugal force causes the tin oxide, which is lighter than the alloy, to be forced to the inner surface of the wave 68 whereby the cleaner alloy goes to the annular recesses 56 and then to the mold cavities 50 before the tin oxide surface layer does, thus minimizing the amount of dross in the cast parts. This, of course, represents another significant advantage of the present invention.

Although the drawings show three ring molds in stacked relation, it will be understood that this invention is applicable to two or more of such molds, although the invention has been found to be particularly effective where three molds are employed in stacked relation. Since the reduction in clamping pressure and rotational speed that results from the present invention minimizes distortion of the mold cavities and hence the cast parts, it has been found that mechanical parts, such as nuts and bolts, can now be effectively produced by centrifugal casting, whereas such has not generally been heretofore possible. Since my new ring molds permit a plurality of said molds to be stacked in a single casting machine, production capacity is increased by a multiple equal to the number of molds employed. It is also important to note that the ring molds of the present invention do not require major modifications to existing casting apparatus. Aside from the labor saving that automatically ensues from the increased production that results from the present invention, the manufacture of the molds per se is easier and less expensive with the ring molds of the present invention, because it is no longer necessary to cut circular reservoirs or back-venting channels into the molds, it being understood that the annular recesses on the inner edge of the molds is automatically formed during the manufacture of the molds. Also, very little skill on the part of the operator is required to effectively operate the multi-mold system of the present invention. Virtually all the operator has to do is to pour the molten metal into the central well of the manifold, whereas in the conventional single-mold centrifugal casting system, the precise clamping pressure of the mold halves is much more critical, shimming of the molds is frequently required, and the amount of molten metal poured into the mold is also a factor of importance. One further advantage of my novel and improved system is the fact that the uniformity of the central circular gate that is attached to the radial gates and the cast parts when the latter are removed from the molds makes it possible to use automated means for checking the cast parts for defects.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In centrifugal casting apparatus of the type comprising a fixed base, a piston plate mounted on said base for receiving thereon a rubber mold comprising face-to-face mold halves having cooperating mold cavities and radially extending gates on their abutting surfaces, and a fixed pressure plate engaging the top of said mold whereby movement of said piston toward said pressure causes clamping of said mold halves against each other, the improvement comprising a plurality of said molds mounted on said piston plate in stacked relation, all of said mold halves being open at their center portions to define ring-like mold members having inner and outer concentric circular edges, and means positioned in the center of said stacked ring-like mold members for receiving and simultaneously introducing molten metal to the gates of each of said molds while the apparatus and molds are rotating, said means comprising a manifold having a cylindrical side wall and a bottom wall, a plurality of passages, the inner ends of which extend from the inner surface of said side wall to the outer surface thereof, with some of said passages terminating adjacent the inner edge of each of said molds, the inner ends of said passages all being located at substantially the same height in spaced relation to said bottom wall but closely adjacent thereto, whereby molten metal introduced to said manifold is simultaneously carried by centrifugal force through said passages to the inner edge of each of said molds, and then through said gates to said mold cavities.

2. In the apparatus of claim 1, each of said molds having an annular recess provided on its inner edge so as to form a reservoir for receiving a supply of molten metal from said passages, each of said annular recesses having a volume greater than the cumulative volume of said cavities and radial gates in its respective mold.

3. In the apparatus of claim 1, said bottom wall having an undulated portion, said undulated portion comprising a centrally positioned hump.

4. In the apparatus of claim 1, there being a plurality of said passages leading to each mold at spaced circumferential locations.

5. In the apparatus of claim 1, said inner circular mold edge being in spaced relation to said outer surface of said cylindrical wall.

6. In centrifugal casting apparatus of the type comprising a fixed base, a piston plate mounted on said base for receiving thereon a rubber mold comprising face-to-face mold halves having cooperating mold cavities and radially extending gates on their abutting surfaces, and a fixed pressure plate engaging the top of said mold whereby movement of said piston toward said pressure plate causes clamping of said mold halves against each other, the improvement comprising the face that said mold halves are open at their center portions to define a ring-like mold member having inner and outer concentric circular edges, and means positioned in the center of said ring-like mold member for receiving and introducing molten metal to the gates of said mold while the apparatus and mold are rotating, said means comprising a manifold having a cylindrical side wall and a bottom wall, a plurality of passages, the inner ends of which extend from the inner surface of said side wall to the outer surface thereof, with said passages terminating adjacent the inner edge of said mold, the inner ends of said passages all being located at substantially the same height in spaced relation to said bottom wall but closely adjacent thereto, whereby molten metal introduced to said manifold is simultaneously carried by centrifugal force through said passages to the inner edge of said mold at circumferentially spaced locations, and then through said gates to said mold cavities.

7. In the apparatus of claim 6, said mold having an annular recess provided on its inner edge so as to form a reservoir for receiving a supply of molten metal from said passages, the volume of said annular recess being greater than the cumulative volume of said cavities and radial gates.

8. In the apparatus of claim 6, said bottom wall having an undulated portion, said undulated portion comprising a centrally positioned hump.

9. In the apparatus of claim 6, said inner circular mold edge being in spaced relation to the outer surface of said cylindrical wall.

* * * * *

UNITED STATES PATENT AND TRADEMARK OFFICE

CERTIFICATE OF CORRECTION

PATENT NO. : 5,135,041

DATED : August 4, 1992

INVENTOR(S) : GOSS, Douglas J.

It is certified that error appears in the above-identified patent and that said Letters Patent is hereby corrected as shown below:

Column 6, line 15,
after "pressure" insert --plate--.

Column 7,
line 15, change "face" to --fact--.

Signed and Sealed this

Twenty-ninth Day of June, 1999

*Attest:*

*Attesting Officer*

Q. TODD DICKINSON

*Acting Commissioner of Patents and Trademarks*